United States Patent [19]

Maxim

[11] 4,006,337

[45] Feb. 1, 1977

[54] APPARATUS AND METHOD FOR HEATING A GUN BARREL BORE

[75] Inventor: John H. Maxim, North Olmsted, Ohio

[73] Assignee: Park-Ohio Industries, Inc., Cleveland, Ohio

[22] Filed: Feb. 9, 1976

[21] Appl. No.: 656,354

[52] U.S. Cl. ..... 219/8.5; 219/10.47; 219/10.57; 219/66; 266/123

[51] Int. Cl.[2] ..... H05B 5/08

[58] Field of Search ..... 219/10.57, 10.47, 7.5, 219/8.5, 59, 66, 67, 10.79, 10.41, 10.43, 10.51; 266/123, 128, 129

[56] References Cited

UNITED STATES PATENTS

| | | | |
|---|---|---|---|
| 2,293,534 | 8/1942 | Denneen et al. | 219/10.79 |
| 2,376,514 | 5/1945 | Somes | 266/123 |
| 3,410,977 | 11/1968 | Ando | 219/10.51 |

*Primary Examiner*—Bruce A. Reynolds
*Attorney, Agent, or Firm*—Meyer, Tilberry & Body

[57] ABSTRACT

An apparatus and method for heating the elongated, generally cylindrical surface of the internal elongated bore of a gun barrel preparatory to quench hardening of the cylindrical surface. There is provided a generally cylindrical inductor extending through the gun bore with electrical connector means between the gun bore and inductor at each end. One of the electrical connecting means includes an electrical circuit between the barrel and inductor wherein the electrical circuit includes means for creating a high frequency alternating current flow in the path including the inductor and gun barrel, in electrical series, whereby heating of the gun barrel is concentrated adjacent the cylindrical surface of the bore.

13 Claims, 4 Drawing Figures

APPARATUS AND METHOD FOR HEATING A GUN BARREL BORE

This invention relates to the art of induction heating and more particularly to an apparatus and method of heating gun barrel bores by combined induction and resistance heating.

The invention is particularly applicable for heating the internal bore of a shotgun barrel and it will be described with particular reference thereto; however, it is appreciated that the application is much broader and may be used for heating projectile guiding bores of various hand held guns.

As is common knowledge, shotgun barrels include an elongated, internal bore through which shotgun pellets are propelled upon discharge of the shotgun. In the past, the internal cylindrical surface of this bore has been polished, generally unhardened steel. Since the pellets being fired were of soft metal, such as lead, the polished, unhardened steel surface was sufficiently abrasion resistant and strong to withstand wearing. It is now proposed that the pellets propelled through the shotgun bore be made from a hard metal, such as steel or iron. The same proposal has been made with respect to bullets fired through rifle barrels which include a cylindrical bore with rifling grooves. When steel or iron shot or bullets are used, the standard unhardened internal bore will tend to be worn. For this reason, there have been efforts to harden the internal surface of the bore of a gun barrel. Indeed, certain procedures have been proposed for hardening the gun barrels. The most common proposal has been to heat the total barrel in a furnace and then quench harden at least the inner bore. This requires a substantial amount of time and energy. To overcome this disadvantage, it has been proposed to provide an induction heating inductor encircling the gun barrel and movable along the gun barrel in a manner similar to the induction heating and quench hardening of an axle shaft in an automobile. This scanning operation would progressively heat, by induction, the total gun barrel. The barrel could be quench hardened by a liquid from a quenching head progressively moved behind the encircling inductor. Such an arrangement results in the advantage of induction heating; however, the total barrel must be heated and quench hardened. This demands a substantial amount of energy, since the total barrel must be raised to a quench hardening temperature. Consequently, these two procedures are not acceptable for mass producing gun barrels.

Internal bores have been inductively heated by a long narrow inductor loop extending into the bore, or an internal scanning inductor movable in the bore. These two procedures are not considered for the barrels of hand held guns because the length of a gun barrel is generally in excess of approximately 25 inches and the bore is quite small. Consequently, an inductor must be extremely long and generally unsupported or long progressively movable support means must be developed for the small bore. Thus, there is a need for a method and apparatus to harden the inner surface of a gun barrel when standard induction heating or furnace heating arrangements are not appropriate.

The present invention relates to an apparatus and method which will harden the inner surface of a barrel for a hand held gun without disadvantages of the various arrangements discussed above.

In accordance with the present invention, there is provided an apparatus for heating the elongated, generally cylindrical surface of the internal elongated bore of a gun barrel by combined induction and resistance heating preparatory to quench hardening of the cylindrical surface. This cylindrical surface has a given diameter and a given length between first and second axially spaced ends. The apparatus comprises an elongated, generally cylindrical inductor having first and second ends and an outer surface with a selected diameter only slightly smaller than the given diameter of the bore and a selected axial length at least as great at the given axial length of the bore. There is also provided a first electrical connector means for electrically connecting the first end of the inductor with the first end of the cylindrical surface of the gun barrel and a second electrical connector for electrically connecting the second end of the inductor with the second end of the cylindrical surface of the gun barrel. Means are provided for centering the outer surface of the inductor within the cylindrical surface of the gun barrel and one of the electrical connecting means includes an electrical circuit between the barrel and the inductor, which electrical circuit includes means for creating a high frequency alternating current flow in a path including the inductor and the gun barrel, in electrical series, whereby the heating of the gun barrel is concentrated adjacent the cylindrical surface of the bore.

In accordance with another aspect of the invention, the alternating current has a frequency greater than about 10 K hertz and preferably in the general range of 10–450 K hertz.

In accordance with another aspect of the present invention, there is provided a method for heating the elongated, generally cylindrical surface of the internal elongated bore of a gun barrel preparatory to quench hardening of the cylindrical surface. In accordance with this method, there is provided a generally cylindrical inductor having first and second ends and an outer surface. This inductor is positioned within the bore with the outer surface of the inductor spaced from and facing the inner surface of the gun barrel. The inductor and gun barrel are then placed in electrical series and a high frequency alternating current is passed through the electrical series circuit including the gun barrel and inductor.

In accordance with the preferred embodiment of the present invention, after the heating operation has been completed, the mass of the gun barrel itself draws heat from the heated surface to cause quenching thereof. Of course, an auxiliary arrangement could be provided for spraying coolant onto the heated surface, either through the inductor or by a separate quenching arrangement.

The primary object of the present invention is the provision of a method and apparatus for heating the internal surface of the bore of a hand held gun preparatory to quench hardening of this surface, which method and apparatus is economical and has low energy requirements.

Still a further object of the present invention is the provision of a method and apparatus as defined above, which method and apparatus heats, by combined induction and resistance heating, only the metal closely adjacent the internal bore surface to a hardening temperature.

Yet another object of the present invention is the provision of a method and apparatus as defined above, which method and apparatus heats, by combined induction and resistance heating, the metal closely adjacent the internal surface of the bore for quench hardening by the remaining metal of the barrel.

Another object of the present invention is the provision of a method and apparatus as defined above, which method and apparatus produces uniform results and can be used for various sized gun barrels having various types of cylindrical surfaces, such as smooth and rifled.

These and other objects and advantages will become apparent from the following description taken together with the accompanying drawings in which.

Figure 1:
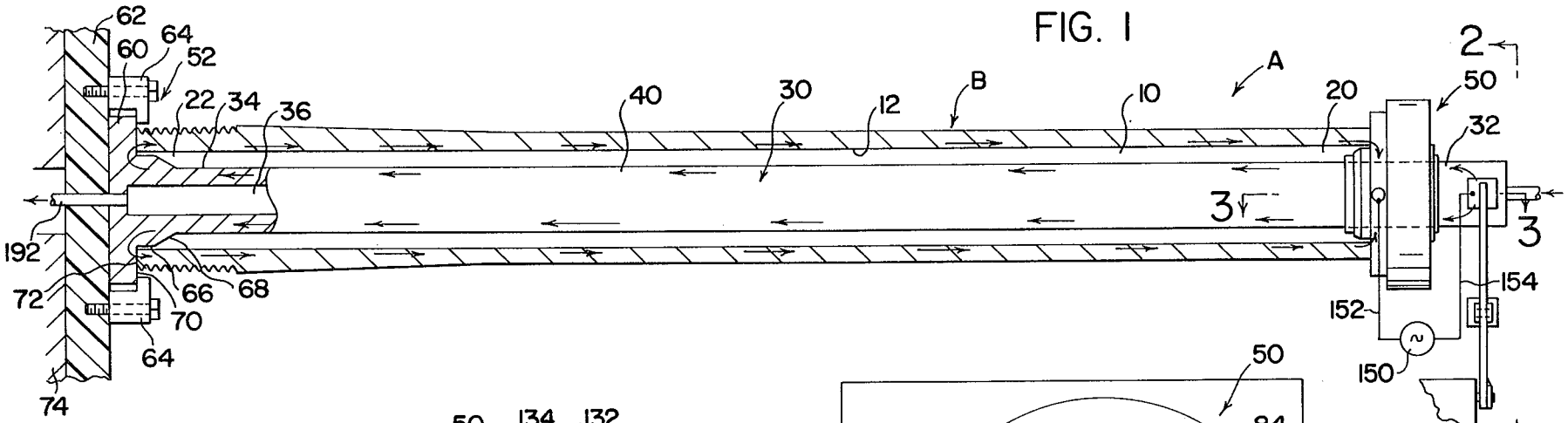
FIG. 1 is a side elevational view showing, schematically, the preferred embodiment of the present invention.

Referring now to the drawings wherein the showing are for the purpose of illustrating a preferred embodiment of the invention only and not for the purpose of limiting same, FIG. 1 shows a heating apparatus A for processing a gun barrel B formed of steel or other quench hardenable metal and having an elongated bore 10 with a generally cylindrical inner surface 12. This bore is a standard shotgun or rifle bore and is either smooth, as shown in FIG. 1, or rifled. Bore 10 includes an internal diamter *a* and has a length of at least approximately 20–25 inches extending between axially spaced ends 20, 22. Apparatus A is used to heat, by combined induction and resistance heating, the metal adjacent surface 12 to a depth generally corresponding to the reference depth of the induction heating portion of the operation. The heated metal is schematically illustrated by the double cross sectioned portion in FIG. 3 and is designated *r*.

Figure 2:
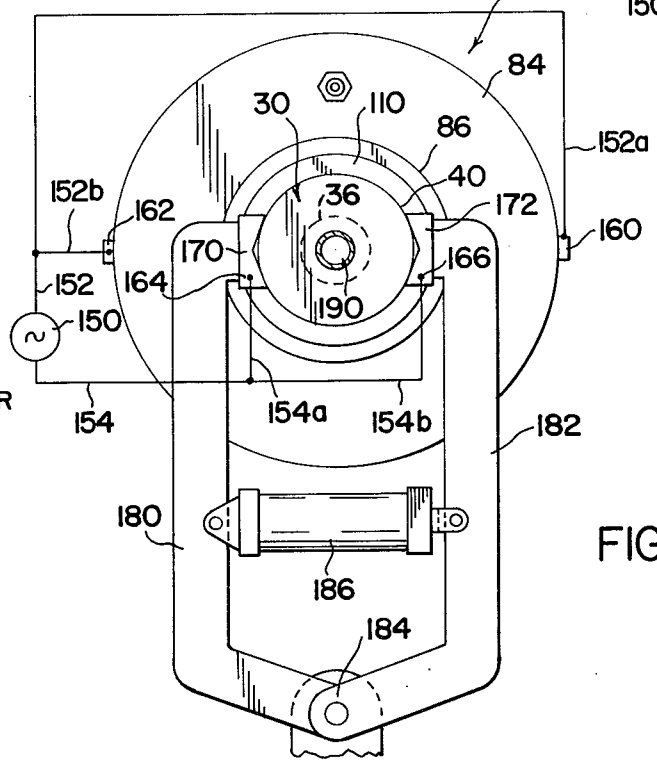
FIG. 2 is an enlarged view taken generally along line 2—2 of FIG. 1.

To cause the heating of the metal closely adjacent surface 12, there is provided an inductor 30 formed from copper, or other highly conductive metal, and having spaced ends 32, 34. This inductor has an internal coolant passageway 36 and an outer generally cylindrical surface 40 matching internal surface 12 of bore 10. Surface 40 has an external diameter b which is only slightly less than the diameter *a* to produce an induction heating air gap *c* which, in the preferred embodiment, is within the general range of 0.035–0.180 inches. Some representative relationships of the dimensions shown in FIG. 2 are set forth below.

When $a = 0.22$ inches, $c = 0.035$–$0.050$ inches.

When $a = 0.75$ inches, $c = 0.100$–$0.180$ inches.

*a* is in the general range of 0.22–0.80 inches. *c* is in the general range of 0.035–0.180 inches.

Figure 4:
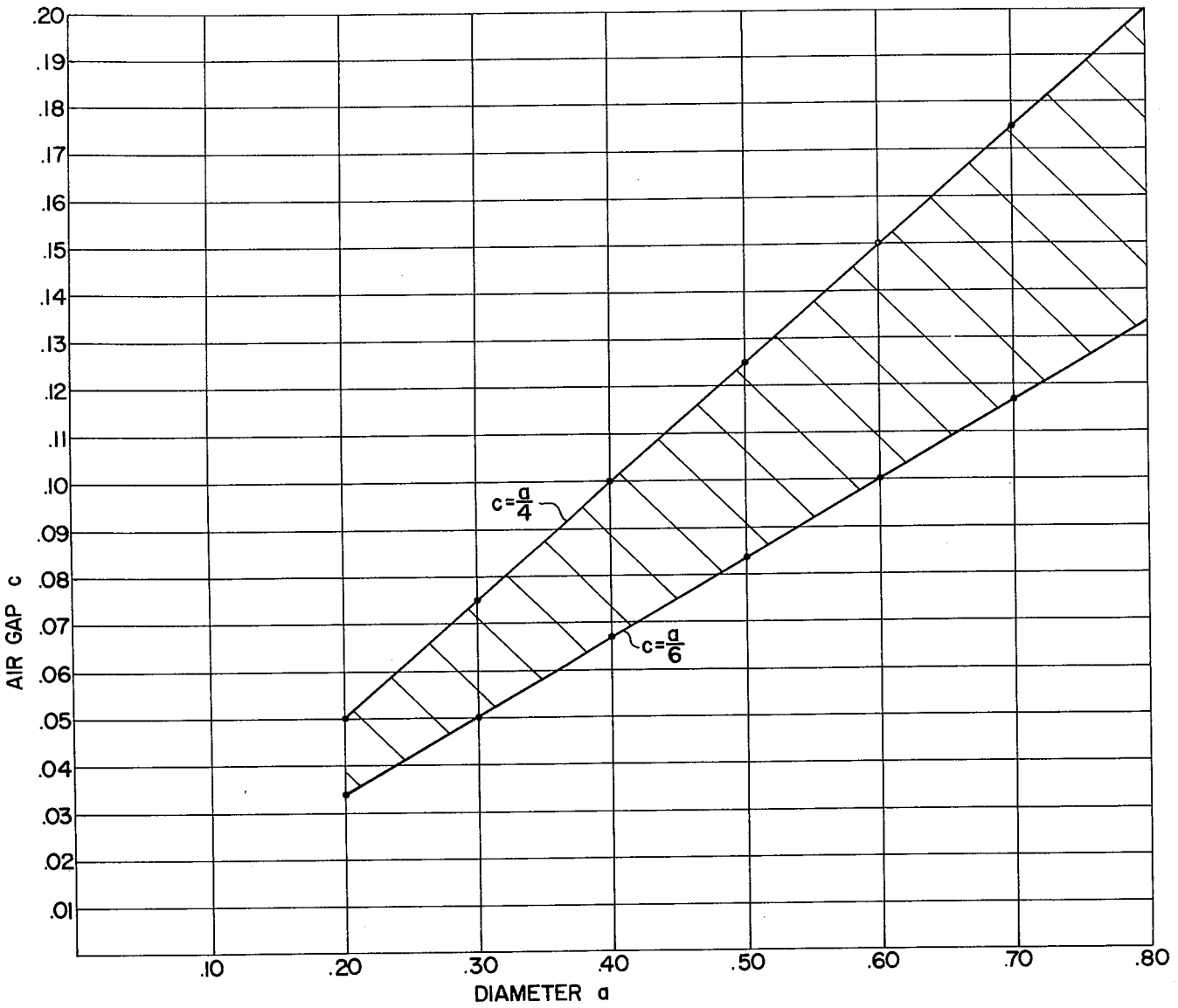

The ratio of $a/2c$ is in the general range of about 2–3 as shown in FIG. 4. These relationships produce the desired combined induction and resistance heating of the metal adjacent surface 12. It is noted that diameter *a* is in the general range of a 22 caliber rifle and a 12 gauge shotgun. When the barrel is for a small caliber gun, such as a 22 caliber rifle, inductor 30 may be near the lower limits of the gap *c*. Even if this small size is used, the inductor must have a length corresponding to the length of the barrel. This length is generally in excess of 20–25 inches. In addition, the inductor should be relatively straight and rigid, so that the air gap *c* can be maintained around surface 12 and over the total length of the processed bore 10. Although it is generally anticipated that the inductor will be used for shotgun barrels, rifles can also be processed. The small rifling ridges will have no effect on the general operation, since the crest of these ridges will be inductively heated for subsequent quench hardening by inductor 30. The quench hardening of the heated metal is by conduction of heat to the metal around the heated metal. Most of the metal of barrel B remains relatively cool during the heating operation. After the heating operation, the cool metal of barrel B rapidly quenches the heated metal by mass quenching. This hardens the metal adjacent surface 12. Of course, this same arrangement could be used for shorter barrels of hand-held guns, such as revolvers and automatics.

Inductor 30 forms the essential part of apparatus A and must be connected at its opposite ends to the barrel so that the inductor and barrel are in electrical series for the heating operation. To accomplish this, electrical connectors must be employed adjacent the two ends of barrel B. A variety of structures could be used for this purpose; however, in the illustrated embodiment of the invention, electrical connectors 50, 52 are used at opposite ends of bore 10 for completing the electrical circuit required in induction heating of surface 12.

Referring first to the electrical connector 52 at end 22 of bore 10, this connector includes a flange 60 formed integrally with or secured to inductor 30. Flange 60 is fastened to insulated block 62 by a plurality of clamps 64. To assure proper location of surface 40 with respect to surface 12, flange 60 is provided with an outwardly facing cylindrical centering, or locating, surface 66 having an inclined nose portion 68. A contact surface 70 is provided on flange 60 and is generally perpendicular to the center of surface 40. Surface 70 coacts with end surface 72 of barrel B to provide a flat electrical contact area between flange 60 and the gun barrel. Flange 60 is formed from a good electrically conductive material which, in the preferred embodiment, is the same material used for inductor 30. Block 62 is secured onto an appropriate support frame 74 which is not essential to the understanding of the present invention.

Referring now to second electrical connector 50 located at end 20 of barrel bore 10, a variety of structures could be used for this connector which establishes an electrical circuit between the barrel and inductor and applies a high frequency alternating current through this series circuit. In accordance with the illustrated embodiment, electrical connector 50 includes an annular pressure piston 80 located in an annular cylinder 82 formed by cap 84 and sleeve 86 having a retaining rib 88. Piston 80 includes annular head 90 with concentric seals 92, 94 and a locating nose 96 with an outwardly facing centering surface 100 and an inclined portion 102. Insulation sleeve 110 is located between sleeve 86 and surface 40 of inductor 30 to prevent electrical contact between the inductor and the barrel, except through the connector means which includes an electrical input to be described later. An arrangement for moving the portion of connector 50 so far described may take a variety of structural forms; however, in accordance with the illustrated embodiment of the invention, a plurality of generally fixed cylinders 130, only one of which is shown, are provided around the periphery of cap 84. Each cylinder includes a rod 182 connected onto cap 84 by a bracket 134. Of course, cylinders 130 are generally secured fixedly with respect to support frame 74 and are movable away from barrel B a distance to allow removal of the barrel from inductor 30. Thus, in the illustrated embodiment, rods 132 must have a travel in excess of approximately twice the length of the processed barrel B. After cylinders 130 shift cap 84 and the structure supported thereby into the position shown generally in FIGS. 1 and 3, the rods 132 are held in place and air is introduced into space 140 through a nipple 142. This applies pressure between contact surfaces 70, 72, as previously decribed, and between contact surfaces 120, 122 which are formed on piston 80 and barrel B, respectively. This pressure acts against rods 132 which are fixed with respect to frame 74 before air is introduced into space 140. Thus, good electrical contact is established between the contact surfaces at both ends of barrel B.

Figure 3:
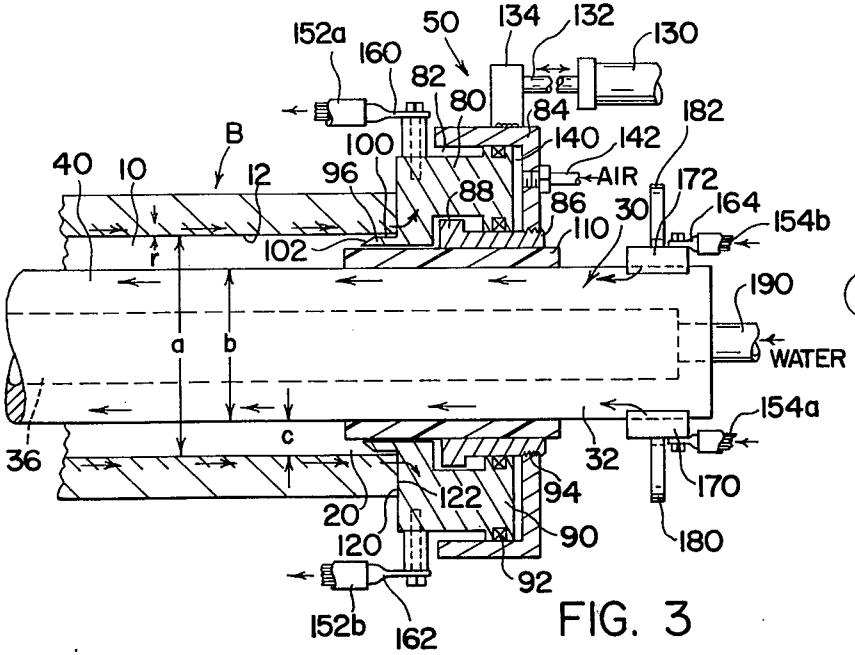
FIG. 3 is an enlarged cross-sectional view taken generally along line 3—3 of FIG. 1; and, FIG. 4 is a graph showing the general range of bore and inductor sizes contemplated by the present invention.

As so far described, there is electrical contact between inductor 30 and barrel B at one end of apparatus A. In addition, there is electrical contact between surfaces 120, 122 at the other end of barrel B. This places the inductor and barrel in an electrical series circuit which is connected across a high frequency power source 150 by the electrical connector 50. This high frequency power source produces an alternating frequency in the range of 10–450 K hertz, and preferably greater than about 100 K hertz. By using this high frequency, the reference depth is relatively small so that metal adjacent surface 12 is heated by the induction portion to a very shallow depth. In the resistance heating portion, current flows as indicated by the arrows of FIGS. 1 and 3. Since this current flow produces opposite flow directions in the barrel and inductor, the proximity effect concentrates current flow adjacent the surfaces of both elements. Thus, both the induction heating and the resistance heating is in the metal closely adjacent surface 12. The remainder of the barrel is unheated to produce a large heat sink for rapid quench hardening when the heating operation is discontinued.

In accordance with the illustrated embodiment of the invention, the power source 150 includes outputs 152, 154 connected onto leads 152*a*, 152*b* and 154*a*, 154*b*, respectively. These leads form a further portion of the electrical circuit created by connector 50 and are attached to the structure best shown in FIGS. 2 and 3 by terminals 160, 162, 164 and 166. Terminals 164 and 166 are, in turn, connected to V-blocks 170, 172 at the ends of clamping arms 180, 182, respectively. These arms are pivoted about pin 184 by an appropriate arrangement, such as a cylinder 186. This clamping arrangement forms the remainder of connector 50 since blocks 170, 172 electrically contact outer surface 40 of inductor 30. This establishes a series circuit including power supply 150, inductor 30 and barrel B.

In operation, cylinder 186 retracts blocks 170, 172 to a position outboard of cap 84. Thereafter, barrel B is placed against surface 70 and centered by surface 66, as shown in FIG. 1. Then, cylinders 130 shift cap 84 into the position shown in FIG. 3 with surfaces 120, 122 in close proximity or in actual contact. Sleeve 110 can be carried by sleeve 86 or manually placed between this sleeve and inductor 30. Thereafter, rods 132 are fixedly secured and air is introduced through nipple 142. This creates electrical contact pressure between surfaces 70, 72 and surfaces 120, 122. At the same time, cylinder 186 brings blocks 170, 172 into electrical contact, as shown in FIGS. 2 and 3, to complete the electrical circuit to inductor 30. When in this position, power source 150 is energized to connect high frequency current through the circuit including inductor 30 and barrel B. Because of the proximity effect and reference depth of the frequency of the alternating current, current flow is maintained in only the skin portion of bore 10. In other words, only material closely adjacent to surface 12 is heated by the current flow from power supply 150. After a preselected time, the metal adjacent surface 12 is raised to the hardening temperature and power supply 150 is disconnected. Immediately thereafter, the metal of barrel B which is relative unheated quenches, by conduction, the previously heated metal adjacent surface 12 to quench harden the same. Of course, an appropriate arrangement could be used for liquid quench hardening if desired. However, this would make the apparatus more complex in operation and structure.

Since diameter *a* is generally less than about 0.80 inch and since the length of bore 10 is generally greater than about 20–25 inches, the use of an inductor to form only a part of the induction heating loop is very beneficial. An elongated, straight cylindrical inductor, hollow or solid, can be manufactured quite easily and can be supported at opposite ends in a centered position. If a loop were to be extended through a small, long bore, a complicated supporting and moving structure would be required.

In accordance with the preferred embodiment, the internal passageway 36 terminates at coolant inlet 190 and coolant outlet 192. An appropriate coolant, such as water, is forced through passageway 36 during the heating operation to maintain a low temperature in a highly conductive metal forming inductor 30. In this manner, only a portion of the inductive loop is actually cooled by the coolant. The remaining portion is part of the workpiece and is to be heated by the current flow.

Having thus described the invention, the following is claimed:

1. An apparatus for heating the elongated, generally cylindrical surface of the internal elongated bore of a gun barrel by combined induction and resistance heating preparatory to quench hardening of said cylindrical surface, said surface having a given diameter and a given length between first and second axially spaced ends, said apparatus comprising: an elongated, generally cylindrical inductor having first and second ends and an outer surface with a selected diameter only slightly smaller than said given diameter and a selected axial length at least as great as said given axial length; a first electrical connector means for electrically connecting said first end of said inductor with the first end of said cylindrical surface of said gun barrel; a second electrical connector means for electrically connecting said second end of said inductor with the second end of said cylindrical surface of said gun barrel; means for centering said outer surface of said inductor within said cylindrical surface of said gun barrrel; and one of said electrical connecting means including an electrical circuit between said barrel and said inductor, which electrical circuit includes means for creating a high frequency alternating current flow in a path including said inductor and said gun barrel in electrical series whereby combined induction and resistance heating of said gun barrel is concentrated adjacent said cylindrical surface of said bore.

2. An apparatus as defined in claim 1 wherein said alternating current creating means includes means for creating an alternating current having a frequency greater than about 10 K hertz.

3. An apparatus as defined in claim 2 wherein said inductor includes an internal passageway extending between said first and second ends of said inductor and means for conducting a coolant through said passageway.

4. An apparatus as defined in claim 3 wherein the ratio of said given diameter to the difference between said given diameter and said selected diameter is in the general range of about 2–3.

5. An apparatus as defined in claim 4 wherein said given diameter is in the general range of 0.20–0.80 inches.

6. An apparatus as defined in claim 1 wherein said inductor includes an internal passageway extending between said first and second ends of said inductor and means for conducting a coolant through said passageway.

7. An apparatus as defined in claim 1 wherein the ratio of said given diameter to the difference between said given diameter and said selected diameter is in the general range of about 2–3.

8. An apparatus as defined in claim 7 wherein said given diamter is in the general range of 0.20–0.80 inches.

9. A method for heating the elongated, generally cylindrical surface of the internal elongated bore of a gun barrel preparatory to quench hardening of said cylindrical surface, said surface having a given diameter and a given axial length between first and second axially spaced ends, said method comprising the steps of:

a. providing a generally cylindrical inductor having first and second ends and an outer surface with a selected diameter only slightly smaller than said given diameter and a selected axial length at least as great as said given axial length;

b. positioning said inductor within said bore with said outer surface spaced from and facing said surface of said gun barrel;

c. connecting said gun barrel and said inductor into an electrical series circuit; and, d. passing a high frequency alternating current through said electrical series circuit.

10. A method as defined in claim 9 wherein said high frequency alternating current has a frequency greater than about 10 K hertz.

11. An apparatus for heating the elongated, generally cylindrical surface of the internal surface of an elongated bore by combined induction and resistance heating preparatory to quench hardening of said cylindrical surface, said surface having a given diameter in the general range of 0.20–0.80 inch and a given length between first and second axially spaced ends, said apparatus comprising: an elongated, generally cylindrical inductor having first and second ends an an outer surface with a selected diameter only slightly smaller than said given diameter and a selected axial length at least as great as said given axial length; a first electrical connector means for electrically connecting said first end of said inductor with the first end of said cylindrical surface of said bore surface; a second electrical connector means for electrically connecting said second end of said inductor with the second end of said cylindrical surface of said bore surface; means for centering said outer surface of said inductor within said cylindrical surface of said bore; and one of said electrical connecting means including an electrical circuit between said bore surface and said inductor, which electrical circuit includes means for creating a high frequency alternating current flow in a path including said inductor and said bore surface in electrical series whereby combined induction and resistance heating of said bore surface is concentrated adjacent said cylindrical bore surface.

12. An apparatus as defined in claim 11 wherein said alternating current creating means includes means for creating an alternating current having a frequency greater than about 10 K hertz.

13. An apparatus as defined in claim 11 wherein the ratio of said given diameter to the difference between said given diameter and said selected diameter is in the general range of 2–3.

* * * * *